United States Patent [19]

Ryan et al.

[11] 4,015,725

[45] Apr. 5, 1977

[54] PIVOTABLE AND EXTENDABLE APPARATUS FOR LIFTING A PERSON TO AND FROM A VEHICLE

[75] Inventors: John Patrick Ryan; Jack B. Hart, both of Indianapolis, Ind.

[73] Assignee: Marion County Muscular Dystrophy Foundation, Indianapolis, Ind.

[22] Filed: Aug. 28, 1975

[21] Appl. No.: 608,507

[52] U.S. Cl. ..... 214/75 R; 214/75 T; 214/672

[51] Int. Cl.[2] ..... B60P 1/44

[58] Field of Search ..... 214/75 R, 75 T, 75 G, 214/670, 672, 674, 660

[56] References Cited

UNITED STATES PATENTS

| | | | |
|---|---|---|---|
| 2,339,020 | 1/1944 | Le Tourneau | 214/672 |
| 2,867,341 | 1/1959 | Tieslau | 214/672 |
| 3,270,899 | 9/1966 | Brown et al. | 214/75 R |
| 3,478,904 | 11/1969 | Courter | 214/75 R |
| 3,710,962 | 1/1973 | Fowler | 214/75 R |
| 3,811,579 | 5/1974 | Black | 214/75 G X |
| 3,823,839 | 7/1974 | Petzing et al. | 214/450 |
| 3,847,292 | 11/1974 | Williams et al. | 214/75 G |
| 3,912,048 | 10/1975 | Manning | 187/9 R |
| 3,918,596 | 11/1975 | Ward | 214/75 R |

*Primary Examiner*—Robert J. Spar
*Assistant Examiner*—Lawrence J. Oresky
*Attorney, Agent, or Firm*—Woodard, Weikart, Emhardt & Naughton

[57] ABSTRACT

An apparatus for lowering and raising a handicapped person from a vehicle. A post is fixedly mounted within the vehicle having a top end pivotally supporting a channel. A member is slidably and telescopically mounted to the channel with a platform pivotally mounted to the bottom end of the member. A screw extends through the channel being threadedly engaged with the member and drivingly rotated by a sprocket and chain combination in turn driven by a motor. Rotation of the screw results in the extension and retraction of the member. A bridge is pivotally mounted in the vehicle and may be swung outwardly forcing the platform outwardly of the truck. The bridge allows for a wheelchair to be moved from the vehicle across the bridge and to the platform which is then lowered. In a second embodiment, the platform is supported by a second member telescopicially mounted to a second channel in turn pivotally mounted to a second post mounted within the vehicle and aligned with the first post.

9 Claims, 5 Drawing Figures

PIVOTABLE AND EXTENDABLE APPARATUS FOR LIFTING A PERSON TO AND FROM A VEHICLE

BACKGROUND OF THE INVENTION

1. Field of the Invention

This invention is in the field of lifts mounted to vehicles.

2. Description of the Prior Art

Devices have been provided for raising and lowering invalids and other persons confined to wheelchairs relative to the ground and a vehicle such as a van. Two such devices are disclosed in the U.S. Pat. No. 3,710,962 issued to Fowler and U.S. Pat. No. 3,847,292 issued to Williams and Gates. Likewise, other types of lifting devices have been provided for raising and lowering freight relative to the transport vehicle. For example, see the U.S. Pat. No. 3,371,805 issued to Himes, U.S. Pat. No. 3,416,677 issued to Abfalter and U.S. Pat. No. 3,776,402 issued to Bryan.

A main objective in designing a lift for a handicapped person is for the lift to be low in cost and readily mountable to a vehicle such as a van without requiring extensive modifications to the vehicle. Many of the prior art devices are relatively complicated having a variety of hydraulic systems for raising and lowering the handicapped person. Likewise, the lift must be designed to mount at both the back doors and side doors of the van. Another main objective is to provide a fail-safe capability. That is, there should be a positive linkage between the actuator and the moving members which prevents the lift from falling in the event that the drive chain or hydraulic system fails. The fail-safe design should also provide a manual capability to lower the lift in the event of failure of the drive chain. Disclosed herein is a new and improved lift which solves the aforementioned problems.

SUMMARY OF THE INVENTION

One embodiment of the present invention is an apparatus for lifting a handicapped person to and from a vehicle comprising a first post fixedly mounted within the vehicle with the post having a top end, a first channel pivotally mounted about a horizontal pivot axis to the top end of the post with the channel having a bottom end swingable outwardly of the vehicle, a first member slidably and telescopically mounted to the channel, a platform movably mounted to the member, first means mounted to said vehicle being operable to swing the member and the platform outwardly clear of the vehicle, second means connected to the channel and to the member being operable to extend the member to position the platform on ground and also operable to retract the member to cooperatively with the first means to position the platform within the vehicle.

It is an object of the present invention to provide a new and improved device for raising and lowering a handicapped person from a vehicle.

A further object of the present invention is to provide a lift mountable to a vehicle with means provided preventing the lift from falling in the event of system failure.

Related objects and advantages of the present invention will be apparent from the following description.

DESCRIPTION OF THE PREFERRED EMBODIMENTS

Figure 1:
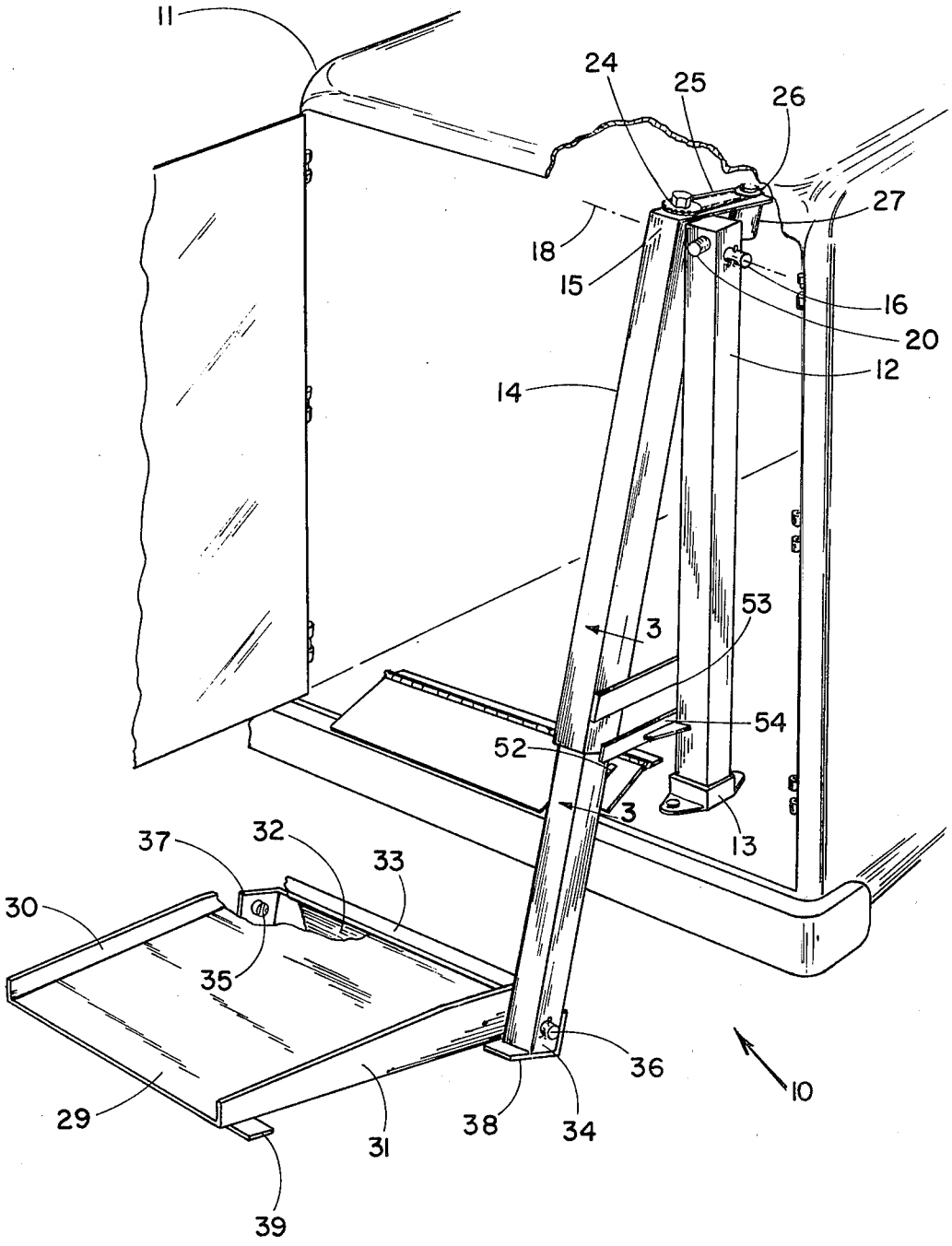
FIG. 1 is a fragmentary perspective view of one embodiment of a lift incorporating the present invention shown mounted to a van vehicle.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 3:
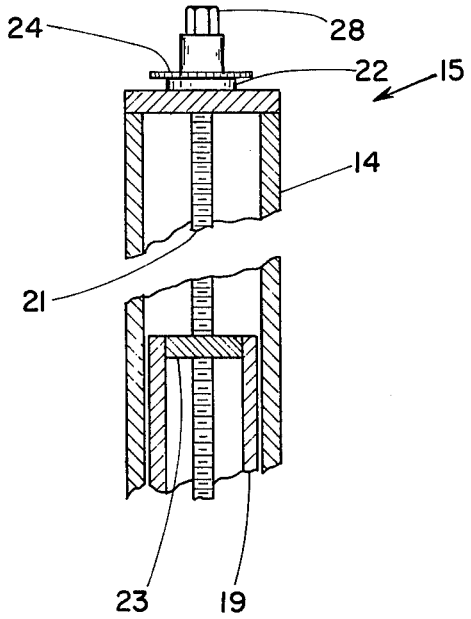
FIG. 3 is a fragmentary and enlarged cross-sectional view taken along the line 3—3 of FIG. 1 and viewed in the direction of the arrows.

Referring now more particularly to FIG. 1, there is shown an apparatus 10 for lifting a handicapped person to and from a vehicle 11. Apparatus 10 includes a post 12 having a bottom flange 13 fixedly mounted within and to the floor of the vehicle. Channel 14 is positioned inwardly of post 12 and has a top end 15 pivotally mounted by pivot pin 16 to the top end of post 12. Channel 14 pivots around horizontal axis 18 which extends through pivot pin 16. Channel 14 is hollow and slidably receives member 19 (FIG. 3) which may be telescopically extended and retracted relative to channel 14. The top end 15 of channel 14 is attached by fastener 20 to the inside of the roof rail of the vehicle thereby securing the lifting apparatus.

Screw 21 (FIG. 3) is rotatably mounted by thrust bearing 22 to the top end 15 of channel 14. Screw 21 extends through channel 14 and is threadedly received by an internally threaded top end 23 of member 19. The top end of screw 21 is fixedly secured to sprocket 24 which is in meshing engagement with a continuous roller chain 25 also in meshing engagement with sprocket 26 mounted to the output shaft of motor 27. Motor 27 is fixedly mounted to the top end 15 of channel 14. Thus, activation of motor 27 results in movement of chain 25 and rotation of sprocket 24 and screw 21. Rotation of screw 21 results in the extension or retraction of member 19 relative to channel 14 depending upon the direction of rotation of the screw. Thus, the telescoping member 19 is positively connected by screw 21 to member 14 and sprocket 24. In the event that chain 25 is accidentally broken, then member 19 will stay in position relative to channel 14. The top end 28 of screw 21 is provided with a hexagonal configuration engageable by a wrench allowing for the manual rotation of screw 21 to raise and lower the platform in the event of failure of the drive chain or motor.

A platform 29 is fixedly secured to a pair of rails 30 and 31 connected together and spaced apart by separator rail 32. The platform is pivotally mounted to support arm 33 fixedly attached to the bottom end 34 of member 19. Pivot pins 35 and 36 extend respectively through flange 37 of arm 33 and the bottom end 34 of member 19 and into side rails 30 and 31 allowing the platform 29 to pivot about the horizontal axis extending through pivot pins 35 and 36. Flange 38 is fixedly mounted to the bottom end 34 of member 19 and extends beneath platform 29 providing a stop surface to limit downward pivotal motion of the platform. A similar flange 39 is fixedly mounted to the outer end of rail 31 and contacts member 14 when the platform is swung to the upward position limiting inward movement of the platform.

Figure 2:
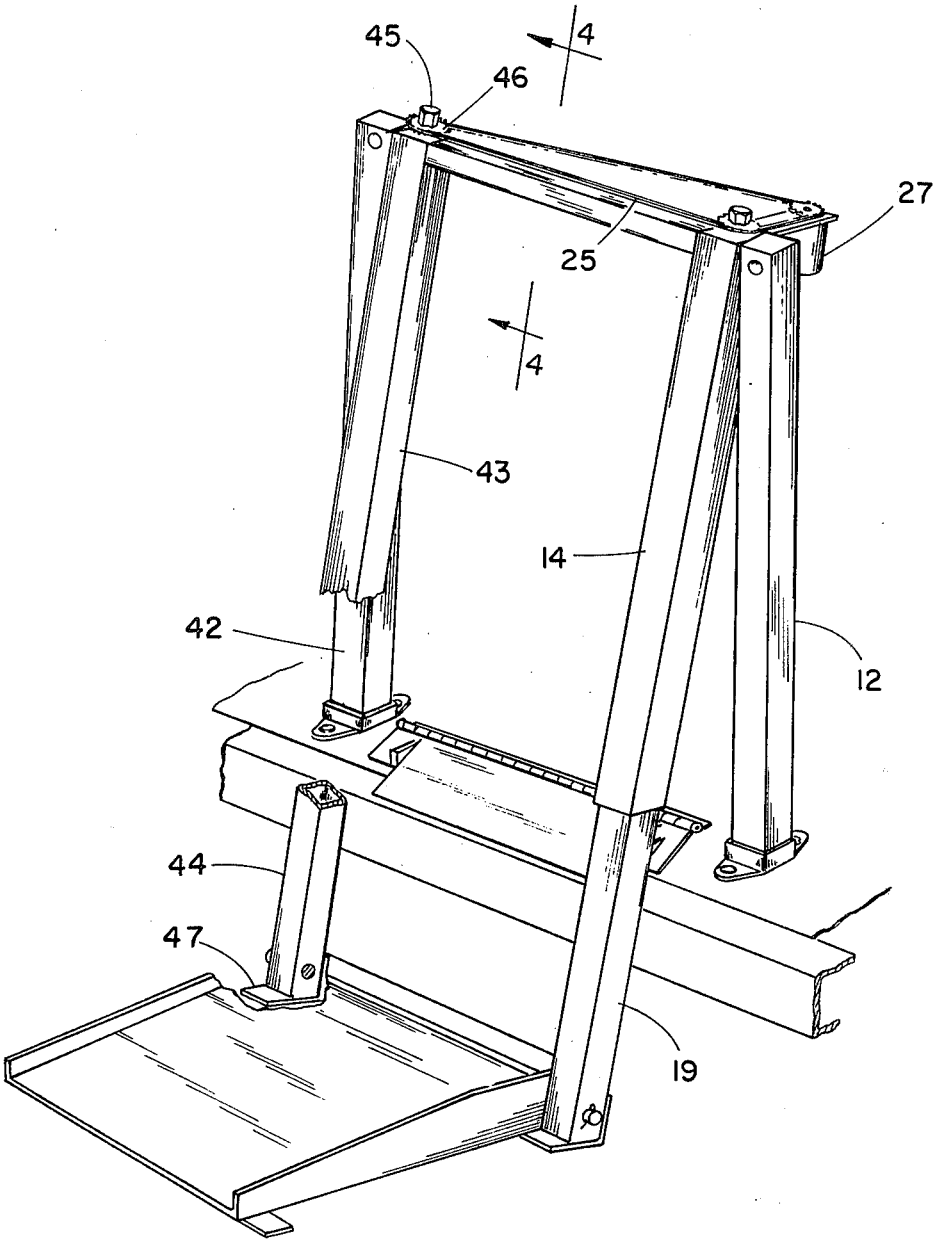
FIG. 2 is the same view as FIG. 1 only showing an alternative embodiment of the lift.

An alternate embodiment of the lift is shown in FIG. 2 and is identical with the lift shown in FIG. 1 with the exception that a second post, channel and member along with a screw threadedly engaged with the member is provided. Thus, a second post 42 is fixedly mounted within the van and is aligned with post 12. A second channel 43 is pivotally mounted about a horizontal pivot axis to the top end of post 42 with member 44 being slidably and telescopically mounted to channel 43 in a manner identical with the mounting of member 19 relative to channel 14. That is, screw 45 is rotatably mounted to the top end of channel 43 and extends therethrough being threadedly received by the top end of member 44. A sprocket 46 is fixedly mounted to the top end of screw 45 and is in meshing engagement with a continuous roller chain 25 in turn in meshing engagement with the sprocket attached to the screw extending through channel 14 and with the output sprocket of motor 27 fixedly mounted to the top end of channel 14. Thus, activation of motor 27 (FIG. 2) results in a simultaneous rotation of both screws extending through channels 14 and 43 resulting in the simultaneous retraction or extension of members 19 and 44 depending upon the direction of rotation of the output shaft of the motor. Likewise, the platform is pivotally mounted to the bottom ends of members 19 and 44. Support arm 33 (FIG. 1) is not provided in the embodiment shown in FIG. 2 since the platform is mounted directly to the bottom ends of both members 19 and 44. Member 44 is provided with an outwardly extending flange 47 which is identical to flange 38 (FIG. 1) of member 19 to limit downward horizontal movement of the platform.

A bridge platform 40 is pivotally mounted by a piano hinge 41 in turn fixedly connected to the floor of van 11. Bridge 40 when swung to its downward position (FIG. 5) extends outwardly of the van and across the bumper 51 of the van allowing movement of a wheelchair from within the van across bridge 40 to platform 29 which is in the upward but outward position.

Bridge 40 provided in the embodiment shown in FIG. 2 is also provided in the embodiment shown in FIG. 1. Bridge 40 includes a pair of upraised triangular-shaped projections 52 which contact channels 14 and 43 forcing the channels and platform outwardly when the bridge is in the horizontal outward position. Thus, the bridge provides a means which is contactable against the channels being operable to move the channels and platform outwardly clear of the vehicle. In the one post embodiment shown in FIG. 1, the triangular-shaped projection contacts only channel 14. A pair of guides 53 and 54 (FIG. 1) are fixedly mounted respectively to member 14 and post 12 to guide the channel and platform as the platform swings into and out of the vehicle. Guides 53 and 54 therefore prevent lateral motion in a direction perpendicular to the outward swinging of the platform.

Figure 4:
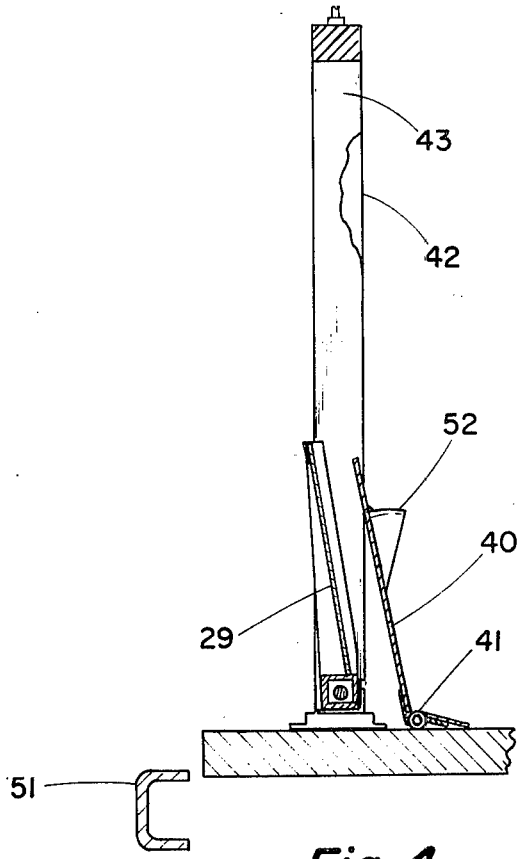
FIG. 4 is a cross-sectional view of the lift of FIG. 2 shown in the retracted position and taken along the line 4—4 of FIG. 2 and viewed in the direction of the arrows.
Figure 5:
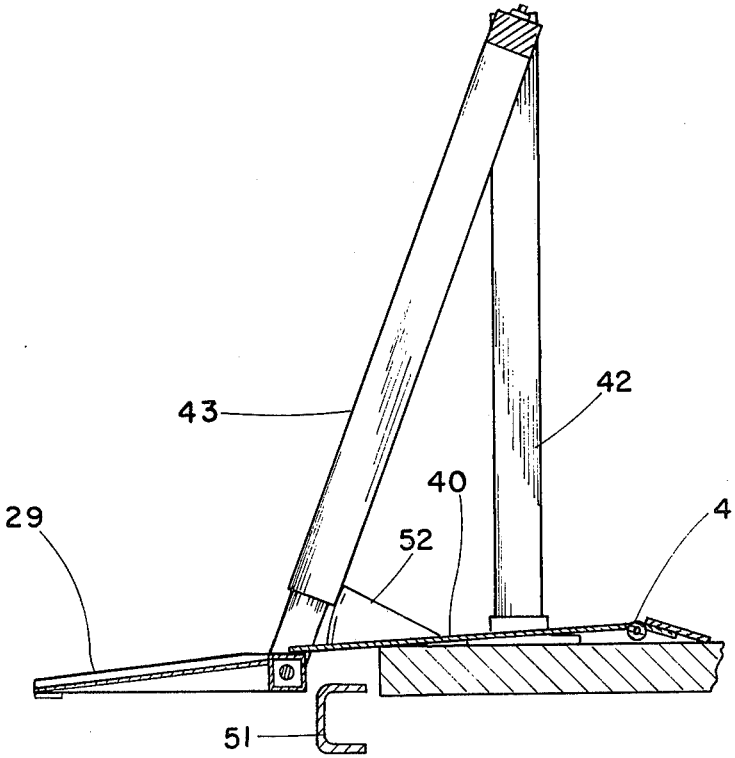
FIG. 5 is the same view as FIG. 4 only showing the lift pivoted outwardly with the platform in the upward position.

In order to operate the lift, bridge 40 is first pivoted outward so as to contact the single member 19 of the lift shown in FIG. 1 or the pair of members 19 and 44 shown in FIG. 2. With the bridge in an outward horizontal position, the platform may be pivoted downward so as to assume a horizontal position. The wheelchair may then be rolled over the bridge and onto the platform. The stored position of the platform when positioned within the vehicle is shown in FIG. 4 whereas the outward position of the platform immediately prior to the lowering of the platform is shown in FIG. 5. Suitable electrical controls are provided within the vehicle adjacent the lift allowing the handicapped person to activate the motor connected to a source of power by circuitry, such as various relays and switches. Activation of the motor then results in the lowering of the platform to the ground. Subsequently, the handicapped person may be lifted into the vehicle by the lift with the wheelchair moving back across the bridge into the vehicle. The platform may then be pivoted upward along with the bridge to the stored position and the doors of the van shut.

Many variations are contemplated and included in the present invention. In lieu of using a continuous roller chain to drive the sprocket mounted to the top end of the drive screws, the present invention also includes the use of continuous belts which are engaged with the output shaft of the motor and with the top ends of the drive screws.

It will be obvious from the above description that the present invention provides a new and improved apparatus for lifting handicapped persons into and out of a vehicle. If will be further obvious from the above description that the present invention provides an apparatus for lifting handicapped persons with the apparatus having a fail-safe capability preventing the lift from falling in the event of system failure.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

The invention claimed is:

1. An apparatus for lifting a handicapped person to and from a vehicle comprising:

a post fixedly mounted within said vehicle with said post having a top end;

a channel pivotally mounted about a horizontal pivot axis to said top end of said post with said channel having a bottom end swingable outwardly of said vehicle;

a member slidably and telescopically mounted to said channel;

a platform movably mounted to said member;

first means mounted to said vehicle for swinging said member and said platform outwardly from and clear of said vehicle; and, second means connected to said channel and to said member for extending said member to position said platform on ground and also for retracting said member to cooperate with said first means to position said platform within said vehicle, said first means includes a bridge pivotally mounted to said vehicle, said bridge when pivoted to a horizontal position has a length extending outwardly of said vehicle to said platform allowing movement of a wheelchair from within said vehicle across said bridge to said platform, said bridge including an abutting surface engaging and thus pivoting said first channel outwardly from said vehicle when said bridge is pivoted to said horizontal position, further said second means is constructed such that said second member can only be extended by operation of said second means.

2. The apparatus of claim 1 and further comprising:

third means extending between said post and said channel operable to guide said channel as said channel swings into and out of said vehicle.

3. The apparatus of claim 1 and further comprising:

third means mounted on said platform and contactable against said first channel operable to limit inward movement of said platform.

4. The apparatus of claim 3 and further comprising:

fourth means mounted on said first member and contactable against said platform operable to limit downward movement of said platform.

5. The apparatus of claim 1 wherein:

said second means includes a motor and a screw, said screw is rotatably mounted to said channel and threadedly connected to said member, said motor is drivingly connected to said screw to rotate said screw extending and retracting said member depending upon the direction of rotation of said screw.

6. The apparatus of claim 5 in which:

said screw includes a head which is located exteriorly of said channel and said member, whereby said screw may be manually rotated relative said channel and said member by engagement of the head.

7. The apparatus of claim 5 and further including:

a motor drivingly connected to said screw and operable to rotate said screw relative said channel and said member.

8. The apparatus of claim 1 and further comprising:

a second post fixedly mounted within said vehicle and aligned with said first post, said second post having a top end;

a second channel pivotally mounted about said horizontal pivot axis to said top end of said second post;

a second member slidably and telescopically mounted to said second channel.

9. The apparatus of claim 8 wherein:

said second means includes a motor and a pair of screws, said screws are rotatably mounted to said first channel and said second channel and threadedly connected to said first member and said second member, said motor is drivingly connected to said screws extending and retracting said first member and said second member depending upon the direction of rotation of said screws.

* * * * *